United States Patent [19]

Jarrett et al.

[11] 4,377,139

[45] Mar. 22, 1983

[54] PUMPING SYSTEMS

[75] Inventors: Boaz A. Jarrett, London; Ivor Fenne, Greenford; Dorian F. Mowbray, Burnham; John E. Mardell, London, all of England

[73] Assignee: Lucas Industries Limited, Birmingham, England

[21] Appl. No.: 174,802

[22] Filed: Aug. 4, 1980

[30] Foreign Application Priority Data

Sep. 18, 1979 [GB] United Kingdom ..... 7932357

[51] Int. Cl.[3] ..... F02B 77/00; F02M 59/42

[52] U.S. Cl. ..... 123/358; 123/198 D; 123/450; 123/179 L; 417/253

[58] Field of Search ..... 123/198 D, 198 DB, 450, 123/358, 359, 357, 179 L; 417/253

[56] References Cited

U.S. PATENT DOCUMENTS

| | | | |
|---|---|---|---|
| 3,283,668 | 11/1966 | Louchio | 91/498 |
| 3,699,935 | 10/1972 | Adler | 123/358 |
| 4,282,843 | 8/1981 | Seilly | 417/253 |

*Primary Examiner*—Charles J. Myhre
*Assistant Examiner*—Carl Stuart Miller

[57] ABSTRACT

A fuel injection pump for supplying fuel to an internal combustion engine includes a plunger reciprocable within a bore by cams on a cam ring. Fuel is supplied to the bore by a throttle. A first valve is provided which connects a point intermediate the throttle and the bore with a drain. A second valve is provided to ensure that the pressure applied to the outer end of the plunger is above said drain pressure. When the first valve is opened the pressure acting at the outer end of the plunger will move it inwardly to ensure that it cannot be actuated by the cam.

5 Claims, 8 Drawing Figures

PUMPING SYSTEMS

This invention relates to a fuel injection pump for supplying fuel to an internal combustion engine and of the kind comprising a plunger reciprocable within a bore, a cam for imparting inward movement to the plunger to displace fuel from the bore to an outlet, a throttle through which fuel can be supplied to the bore to effect outward movement of the plunger and governor means for adjusting the setting of the throttle whereby the amount of fuel delivered through the outlet can be varied.

Where the engine to which fuel is being supplied is a vehicle engine a condition often arises in which the engine is driven by the vehicle, for example when the vehicle is descending a hill and the driver has removed his foot from the throttle pedal. In this condition the aforesaid throttle will be closed and in theory no fuel will be supplied to the engine. In practice, it is found that very small quantities of fuel continue to be delivered to the engine in a poorly atomised state with the result that the fuel is not properly burnt in the engine and objectionable smoke issues from the engine exhaust. The continued supply of fuel is due in some cases to leakage of fuel past the throttle but mainly due to the fact that a small quantity of fuel flows back into the bore containing the plunger as the plunger or an associated part moves over the crest of the cam.

It is known to provide a shut off valve which when actuated prevents the supply of fuel to the bore. However, this does not solve the problem of the continuing supply of fuel mentioned above even though it will have the effect that when it is closed insufficient fuel will be supplied to the engine so that the engine will stop.

The object of the present invention is to provide a pump of the kind specified in a simple and convenient form.

According to the invention a pump of the kind specified comprises first valve means communicating with a point intermediate the throttle and the bore, said first valve means when opened, lowering the pressure down-stream of the throttle to a drain pressure and second valve means for controlling the pressure applied to the outer end of the plunger so that in use, it is maintained at a value which is higher than said drain pressure, the arrangement being that when said first valve means is opened the plunger will be moved inwardly by the pressure at its outer end, by an amount to ensure that it cannot be actuated by the cam.

One example of a fuel injection pump in accordance with the invention will now be described with reference to the accompanying drawings in which.

Figure 1:
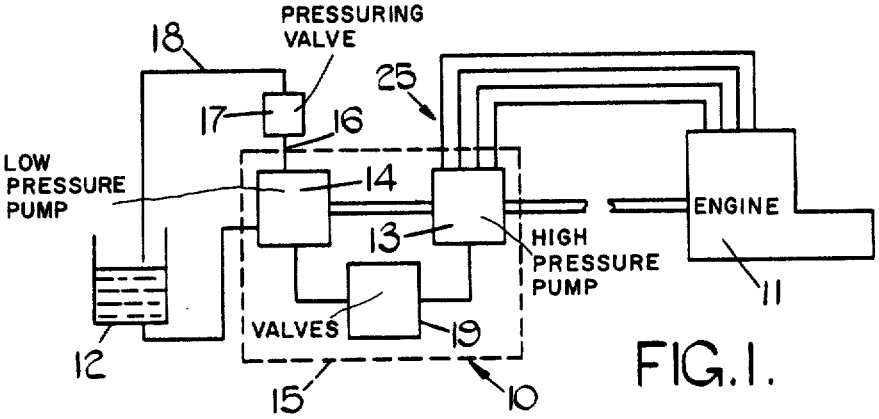
FIG. 1 is a diagrammatic illustration of an engine installation.
Figure 2:
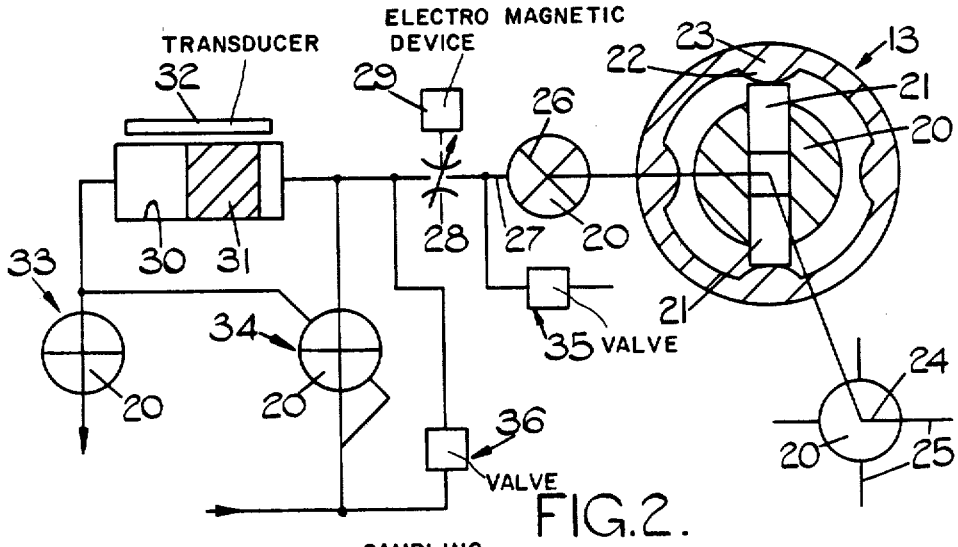
FIG. 2 is a diagrammatic representation of a part of the fuel pump.

With reference to FIGS. 1 and 2 of the drawings a fuel injection pump is indicated at 10 for supplying fuel to an engine 11, the fuel being drawn from a fuel tank 12. The pump includes a high pressure pump 13 and a low pressure pump 14, the latter having an inlet which is connected to the fuel tank 12. As shown in FIG. 1 the low pressure pump and the high pressure pump are located within a housing 15 having an outlet 16 which through a pressurizing valve 17 is connected to a pipe 18 through which fuel can be returned to the tank 12. The rotary parts of the low pressure and high pressure pump are interconnected and are driven in timed relationship with the associated engine. The outlet of the low pressure pump 14 is connected to the inlet of the high pressure pump 13 by way of a plurality of valves indicated by the block 19 but which will be described in greater detail with reference to FIG. 2.

As shown in FIG. 2 the high pressure pump 13 includes a rotary part 20 in which is formed a transversely extending bore mounting a pair of plungers 21. The plungers 21 are arranged to be moved inwardly by the action of cam lobes 22 which are formed on the internal peripheral surface of a cam ring 23. The rotary part 20 is of course driven in timed relationship with the engine and the bore containing the plungers communicates with a delivery passage indicated at 24 and which can communicate in turn with outlets 25 the outlets as shown in FIG. 1, being connected to the injection nozzles of the associated engine.

The bore containing the plungers 21 communicates with a plurality of inlet passages 26 formed in the rotary part 20 and which can register in turn with an inlet port 27 such registration occuring whilst the plungers are permitted outward movement by the cam lobes. The inlet port 27 communicates by way of an adjustable throttle 28 the setting of which is controlled by an electro-magnetic device 29, with one end of a cylinder 30. The throttle 28 is biased to the closed portion by means of a spring. The cylinder contains a shuttle 31 and for sensing the position of the shuttle within the cylinder there is provided a transducer 32. The other end of the cylinder 30 communicates with a valve 33 by which means the said other end of the cylinder can be placed in communication with the interior of the housing 10. This communication is shown as being established and the one end of the cylinder by way of a valve 34 is in communication with the outlet of the low pressure pump 14 so that fuel is flowing to the one end of the bore and the shuttle will therefore be moved towards the other end of the bore. The valve 34 is also able to place the afore-said other end of the cylinder in communication with the outlet of the low pressure pump 14 and this communication is established when the inlet port 27 is in communication with one of the inlet passages 26. As the rotary part 20 rotates therefore the shuttle partakes of forward and reverse motion within the cylinder 30 and during the forward motion fuel is displaced from said one end of the cylinder and flows by way of the throttle 28 to the bore containing the plungers 21. The amount of fuel which flows to the bore is of course determined by the setting of the throttle 28 and the quantity of fuel which flows can be ascertained from the output of the transducer 32.

FIG. 2 also shows two further valves, namely valve 35 which is an electrically operated valve which is spring biased to the open position. The valve 35 is placed in a connection between a point downstream of the throttle 28 and a drain which conveniently may be pipe 18 downstream of the valve 17. The remaining valve i.e. valve 36, may be an electrically operated valve in which case it is spring biased to the closed position, or it may be a valve which is responsive to the output pressure of the low pressure pump 14 in which case it is spring biased to the closed position. It is connected in a conduit extending between the outlet of the pump 14 and a position upstream of the throttle 28. The output pressure of the low pressure pump 14 is arranged to vary in accordance with the speed at which the engine is operating and the valve 36 when open, permits fuel to flow directly from the outlet of the low pressure pump by way of the throttle 28 to the bore containing the plungers 21. In this manner more fuel can be supplied to the bore containing the plungers 21 than would be permitted by the maximum stroke of the shuttle 31. The actual amount of fuel which can flow will be determined by stops which physically limit the outward movement of the plungers 21. The reason why the valve 36 is provided in the particular example rather than extending the stroke of the shuttle 31 is that it is necessary during the operation of the pump to check the calibration of the transducer 32 and this can be achieved by allowing the shuttle to partake of its maximum stroke within the cylinder even though at the particular time, the driver is not calling for maximum fuel. This method of calibration has been found not to upset the operation of the engine or even to cause objectionable smoke in the engine exhaust. It is thought however that if the stroke of the shuttle were extended so as to be able to supply the required amount of extra fuel for starting purposes, then smoke would appear in the engine exhaust.

As mentioned above the valve 36 can be electrically operated or it can be responsive to the output pressure of the low pressure pump 14. If it is responsive to the output pressure then as the latter increases the valve will move to the closed position. When the valve is electrically operated as in the present example, special control circuits which will be described, are provided for its control.

The purpose of the valve 35 which for delivery of fuel by the high pressure pump to take place must be closed, is to prevent fuel being supplied through the outlets in engine overrun conditions. When the valve 35 is opened the pressure at the inlet 27 will fall to substantially the drain pressure which will be appreciably lower than the pressure within the housing 10. The outer ends of the plungers 21 are however subject to the pressure in the housing and the practical effect is that when the valve 35 is opened and when the inlet 27 registers with an inlet passage 26, the plungers 21 will be driven inwardly so that they cannot be actuated by the cam lobes. The valve 35 can be used to effect stopping of the engine as well as during engine overrun conditions, to ensure that no fuel is supplied to the engine. Unfortunately with this arrangement when it is required to supply fuel to the engine after a period of overrun, the plungers will be in their inner most positions and fuel will not be delivered to the engine after closure of the valve 35 until sufficient fuel has flowed into the bore containing the plungers to move them outwardly so that they are engaged or moved inwardly, by the cam lobes. A special arrangement therefore is necessary for controlling the operation of the valve 35 and this will be described in detail below.

Figure 3:
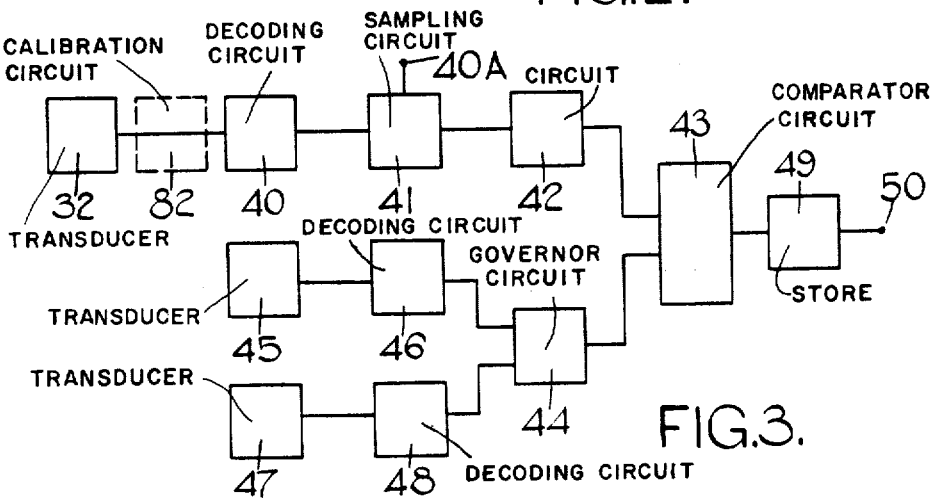
FIGS. 3–8 are block diagrams of a control arrangement for the pump.

Referring now to FIG. 3. This figure shows the governor circuit which provides an output signal which is supplied to the device 29 which sets the throttle 28. The circuit is divided into two portions, the first of which includes the transducer 32 the output of which is supplied to a decoding circuit 40. This has its output connected to a sampling circuit 41 which samples the position of the shuttle at specific points in the pump cycle and for this purpose has a control input 40A. The output of the sampling circuit 41 is connected to a circuit 42 which provides as its output, a signal indicative of the stroke of the shuttle and therefore the amount of fuel supplied to the bore. This signal is applied to one input of a comparator circuit 43. The other input of the comparator circuit is derived from a governor circuit 44 which may be an "all speed" or a "two speed" governor. The governor is provided with a signal indicative of the engine speed by means of a transducer 45 and associated decoding circuit 46 and a further signal indicative of the position of the throttle pedal of the vehicle by means of a transducer 47 and associated decoding circuit 48. The output of the governor 44 is a demanded fuel signal and this is compared in the comparator 43 with the actual fuel signal. The output of the comparator 43 is the difference between these two signals and it is representative of any change required in the setting of the throttle 28. The signal is stored in a store 49 and this store is up-dated each time fuel is delivered to the bore. The output signal from the store 49 will therefore be a continuous signal the value of which will vary as the speed of the engine and/or the demand varies. For convenience the output of the store is connected to a terminal referenced 50.

Figure 5:
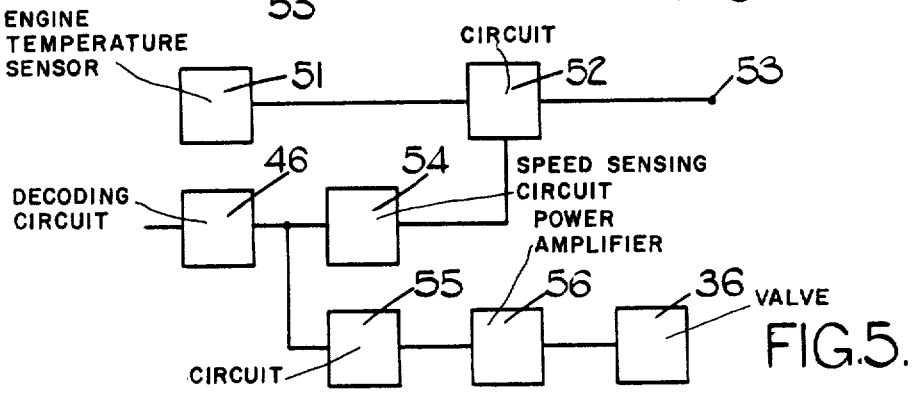

Reference will now be made to FIG. 5 which shows the circuit arrangement for controlling the valve 36 which is the valve which is opened when it is required that excess fuel should be supplied to the engine. It is of course assumed that the valve is electrically operated. During the supply of excess fuel it is desired to modify the quantity of excess fuel supplied in accordance with engine temperature and as shown in FIG. 5, an engine temperature sensor 51 is provided which supplies a signal to a circuit 52 which determines for a given engine temperature, the amount of fuel which should be supplied to the bore containing the plungers 21. The output of the circuit appears at a terminal 53. It is required that no addditional or excess quantity of fuel should be supplied if the engine speed exceeds a first predetermined value and therefore the output of the aforesaid decoding circuit 46 is applied to a speed sensing circuit 54 which when the engine speed exceeds the predetermined value supplies a signal to the circuit 52 to maintain the signal 53 at a set high value.

In addition, the speed signal is applied to a circuit 55 which releases a signal to open the valve 36 when the engine speed is below a second predetermined value. The output of the circuit 55 is applied by way of a power amplifier 56 to the valve 36. In operation, when the engine is cold and is cranked for starting purposes the moment the power is supplied to the control system the valve 36 will be opened and the throttle will be set so that the maximum flow of fuel occurs to the bore containing the plungers 21. When the engine starts then as soon as the second predetermined engine speed is attained the valve 36 will be closed and the supply of excess fuel will be discontinued. The amount of excess fuel is of course determined by the setting of a throttle thus if the engine is warm then the amount of excess fuel supplied will be less. When the engine speed exceeds the first predetermined value then the signal at the terminal 53 assumes the aforesaid value.

Figure 6:
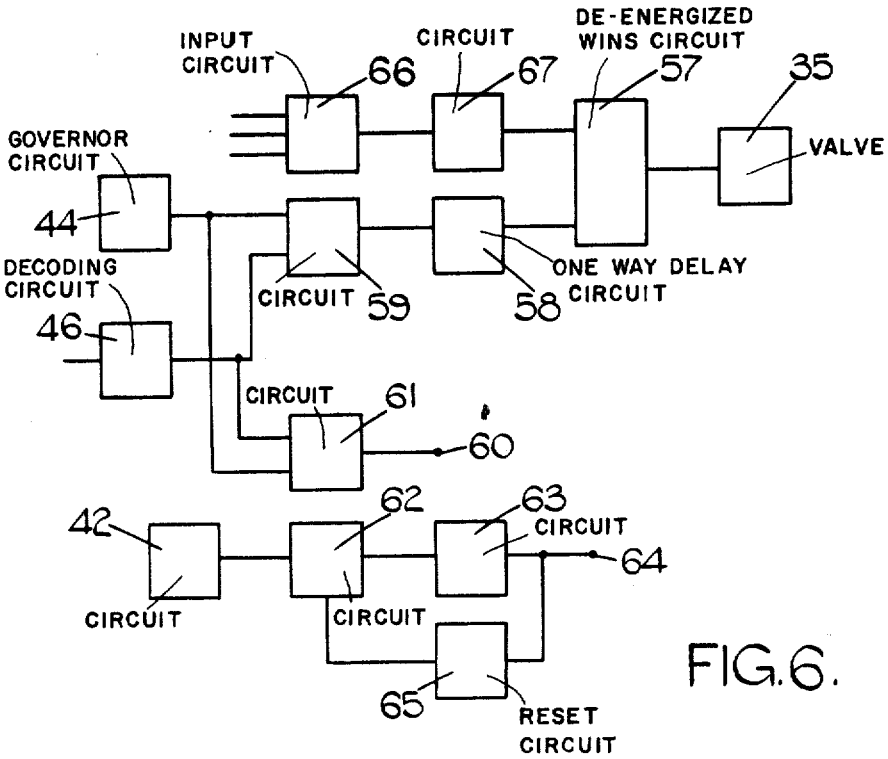

With reference now to FIG. 6 this shows the portion of the control circuit which provides control of the valve 35 and the throttle 28 during engine overrun conditions. The control current for the valve is supplied by a de-energised wins circuit 57 having a first input connected to the output of a one way delay circuit 58 the input to which is provided by a circuit 59 which provides a signal to de-energise and therefore open the valve 35 in the event that the demanded fuel as determined by the governor circuit 44 is zero and if the engine speed is greater than a third predetermined speed which equals the engine idling speed thus a third engine speed value. The circuit 59 therefore receives a fuel demand signal from the governor circuit 44 and a speed signal from the decoder 46. In operation if the engine speed is greater than the third predetermined speed and the demanded fuel is zero, the valve 35 will be opened after the time delay set by block 58, and as described the plungers 21 will be driven inwardly their maximum extent so that no fuel whatsoever will be supplied to the engine. If however the driver of the engine demands fuel by depressing the throttle and the governor circuit decides that fuel can be safely supplied, the circuit 59 will cease to provide the de-energise signal and without any delay by the delay circuit 58, the valve 35 will be closed. Upon closure of the valve there will be a delay whilst the passages in the rotary member and the bore containing the plungers 21 are filled with fuel.

If no demand is made by the driver as the engine speed falls then the circuit 59 will ensure that the valve 35 remains open until the aforesaid third predetermined speed is attained. Once the engine speed falls to the third predetermined speed then the valve 35 will be closed. The passages and the bore will not however be filled with fuel since the governor circuit will maintain the throttle closed. This condition is allowed to remain until the engine speed falls to a fourth predetermined speed which is equal to the engine idling speed plus a fourth engine speed value less than the aforesaid third speed value. At this point the passages within the rotary member and the bore containing the plungers are primed with fuel. This is achieved by opening the throttle 28 as will be explained below. The delay circuit operates to provide a delay in the opening of the valve thus a momentary closing of the throttle by the driver will not cause opening of the valve.

Referring again to FIG. 6 a circuit 61 is provided which provides an output to open the throttle 28 at a terminal 60, when the demand is zero and the speed of the engine falls to said fourth predetermined value. If the throttle were allowed to remain open then the pump would supply fuel to the engine after the priming of the passages and the bore containing the plungers had been completed, even though the demand would still be zero. In order to prevent this a circuit 62 is provided which receives the output from the circuit 42 i.e. the signal representative of the amount of fuel supplied to the bore containing the plungers 21. The circuit 62 sums the fuel quantity values and the output is applied to a circuit 63 which compares the summed value with a reference quantity equal to the amount of fuel required to move the plungers 21 outwardly by an amount so that they are at a predetermined and desired position for example, just clear of the crests of the cam lobes. When the summed quantity is equal to the reference quantity a signal is provided at terminal 64 to close the throttle 28 and this signal is also supplied through a reset circuit 65 to reset the circuit 62. Thus, the various passages and the bore are filled with fuel and the instant the throttle is opened, fuel will be delivered to the associated engine during the next inward movement of the plungers.

FIG. 6 also shows a safety network which provides a de-energise signal to the wins circuit 57. The network includes an input circuit 66 which receives inputs from various transducers and checks to see if the inputs are within prescribed limits. The transducers may be responsive to various engine and vehicle operating parameters such for example as oil pressure, engine temperature and the level of fuel in the tank. If one of the signals goes outside the limit, a signal is provided to a circuit 67 which provides a de-energise signal to effect de-energisation of the valve 35 and hence the supply of fuel to the associated engine will cease.

Figure 4:
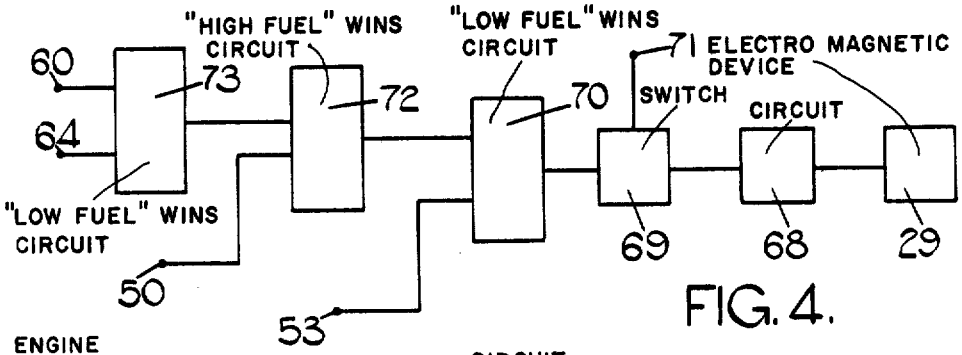

Turning now to the circuit shown in FIG. 4. This is the circuit to which the various signals developed by the previously described circuits are brought together to provide control of the throttle 28. The supply of electric power to the actuator 29 is provided by a circuit 68 which is connected through a switch 69 to the output of a "Low Fuel" wins circuit 70. The switch 69 is normally closed but can be opened by the application of a signal to a terminal 71 from a safety circuit additional to the circuit 66 and 67.

One input of the circuit 70 is taken from a "High Fuel" wins circuit 72 and another input is connected to the terminal 53. The wins circuit 72 has one input connected to the terminal 50 and another input to the output of a "Low Fuel" wins circuit 73 having its two inputs connected to the terminals 60, 64.

In operation, the output of the circuit 70 is the lower of the signals at the terminal 53 and the output of the circuit 72. Thus when the associated engine is being started then the signal at the terminal 53 will be the lower it being arranged to the lower than the signal at terminal 50, the output of circuit 73 being low as previously described, and an excess of fuel will be delivered to the engine. The volume of the excess fuel flow will depend on engine temperature and also engine speed and when either or both the temperature or speed are above predetermined values, the signal at terminal 53 will assume the aforesaid high set value and the output of the circuit 72 will constitute the control for the throttle. Circuit 72 is a "High Fuel" wins circuit and under normal engine operation when fuel is required to be supplied to the engine the signal at the terminal 50 will be the signal which appears at the output of the circuit 50. When no fuel is supplied to the engine because of normal governor action, the output of the circuit 72 will be low or zero. Under engine overrun conditions and when the engine speed falls to the said fourth predetermined value an output will be provided by the circuit 73 which will pass through the circuit 72 and 70 to constitute the control for the throttle. This signal will exist for only the length of time required to prime the passages in the rotary member and the bore containing the plungers 21. Clearly if during engine overrun conditions a demand is placed upon the engine then the signal at the terminal 50 will effect control of the throttle.

As an illustration of the aforesaid speed values then assuming an engine idling speed of 1000 R.P.M. then the third and fourth predetermined speeds would be 1500 and 1100 R.P.M. respectively, the important point being that the various passages and the bore should be primed with fuel before the idling speed of the engine is attained. If this is not achieved the engine may stall before the pump starts to supply fuel.

As briefly mentioned it is necessary to check the calibration of the transducer associated with the shuttle. For calibration to take place it is necessary to assume that the shuttle partakes of a known stroke. It is not intended that the shuttle should act as a device to determine the maximum amount of fuel which can be supplied to the engine and therefore the maximum possible stroke of the shuttle will be slightly in excess of the normal maximum. As previously mentioned it is possible to allow the shuttle to partake of its maximum possible stroke providing this would not result in too much fuel being supplied to the engine providing the engine is being supplied with at least 70% of the normal maximum quantity of fuel.

An alternative system of calibration is possible with the form of pump described and this will be dealt with in outline first. During engine overrun conditions when there is no demand and when the engine speed is above the third predetermined value, the valve 35 is open and the throttle 28 closed. As a result the shuttle will be located at the left hand end of the cylinder 20. If during this condition the throttle 28 is opened when the setting of the valves 33, 34 is appropriate the shuttle will move towards the other end of the cylinder but no fuel will flow through the inlet port 27 because the valve 35 is open. If the throttle is opened fully then the shuttle will move to the right hand end of the cylinder and stay in this position since when the valves 33, 34 reverse it is unlikely that sufficient pressure will be generated at the right hand end of the cylinder because of the fully open throttle, to effect movement of the shuttle. If however the throttle is only open a sufficient amount to cause the shuttle to move to the right hand end of the cylinder then sufficient pressure may be developed at the right hand end of the cylinder when the valves 33 and 34 reverse again to move the shuttle back to the left hand end of the cylinder. Thus there may be one excursion of the shuttle or a number of excursions depending on the setting of the throttle.

Checking of the calibration of the transducer can take place at any engine speed above the aforesaid third predetermined value when the demand is zero. It can be arranged to take place at a specific engine speed within the range or it can take place at fixed intervals at any engine speed in the range.

Figure 7:
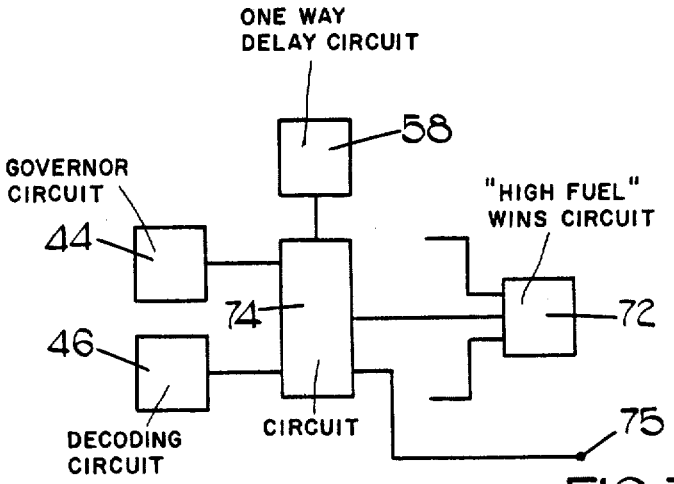

As shown in FIG. 7 a circuit 74 is provided which receives the fuel demand signal and the engine speed signal. It also receives a signal from the time delay circuit 58 and when the demand is zero and the speed a fifth predetermined value in the speed range, it provides a signal to the wins circuit 72 when the de-energise signal has passed through the time delay circuit 58. Thus only when the valve 35 is open is the throttle 28 opened again to cause movement of the shuttle in the cylinder. The circuit 74 provides an additional output at a terminal 75 to cause operation of the transducer calibration circuit.

Figure 8:
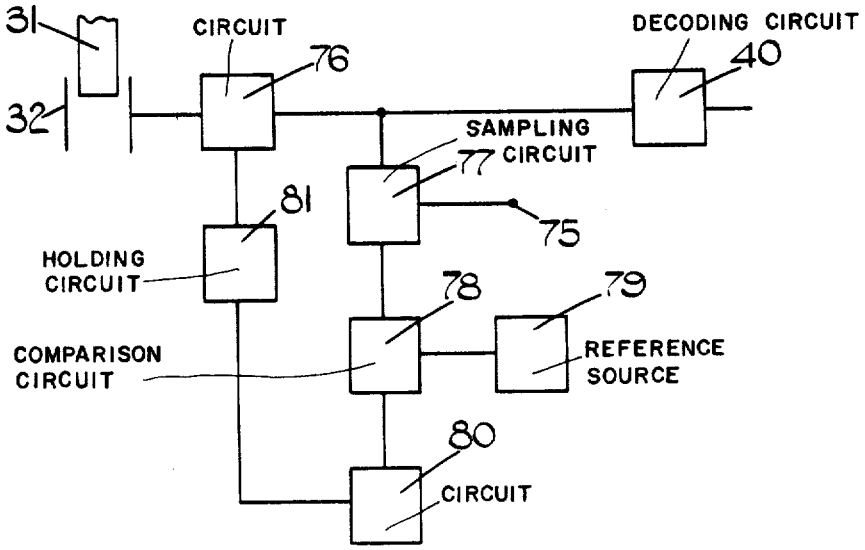

The calibration circuit is shown in FIG. 8 and is interposed between the transducer 32 and the decoding circuit 40, as shown at 82 in FIG. 3. In this case the transducer is of a capacitive type and its output is supplied to an electrical circuit 76 which includes an adjustable gain amplifier. The output of the circuit 76 is the signal which is applied to the de-coding circuit 40 but this signal is also applied to a sampling circuit 77 which receives a control signal from the terminal 75. The sampling circuit therefore only samples the output of the transducer when it is known that the excursion of the shuttle 31 is at its maximum. The output of the sampling circuit is applied to a comparison circuit 78 which also receives a reference signal from a reference source 79. The value of the reference signal is of course predetermined. In the event that there is a difference between the output of the sampling circuit 77 and the reference source 79, this difference is applied to a circuit 80 which determines the adjustment which is required to the gain of the amplifier 76. The signal at the output of the circuit 80 is stored in a holding circuit 81 and therefore a continuous correction signal is applied to the circuit 76. The value of the correction signal varies as required.

We claim:

1. A fuel injection pump for supplying fuel to an internal combustion engine comprising a plunger reciprocable within a bore, a cam for imparting inward movement to the plunger to displace fuel from the bore through an outlet, a throttle through which fuel can be supplied to the bore to effect outward movement of the plunger, governor means for adjusting the setting of said throttle whereby the amount of fuel delivered through the outlet can be varied, first valve means communicating with a point intermediate the throttle and the bore, said first valve means when opened lowering the pressure downstream of the throttle to a drain pressure, second valve means for controlling the pressure applied to the outer end of the plunger so that in use, it is maintained at a value which is higher than said drain pressure, the arrangement being that when said first valve means is opened the plunger will be moved inwardly by the pressure at its outer end, by an amount to ensure that it cannot be actuated by the cam, circuit means for controlling the operation of said first valve means, said circuit means receiving a fuel demand signal from said governor means and an engine speed signal, said circuit means operating to open said first valve means when the fuel demand signal is zero and the engine speed is above a predetermined value, said circuit means being arranged to cause closure of said first valve means when the speed falls to said predetermined value and if the governor means provides a fuel demand signal, and further circuit means operable to effect momentary opening of said throttle when the demand is zero and the engine speed has fallen to a further predetermined value less than said first mentioned predetermined value to prime the passages of the pump including the bore, and to move the plunger outwardly by an amount so that when said governor means provides a fuel demand signal to open the throttle, fuel will immediately be supplied by the pump.

2. A pump according to claim 1 including means for measuring the amount of fuel which flows through the throttle when it is momentarily opened.

3. A pump according to claim 1 including a shuttle slidable within a cylinder, a passage connecting one end of said cylinder with said throttle, means for displacing said shuttle within said cylinder to cause fuel to be delivered through said throttle to said bore when said first valve means is closed, and transducer means for providng a signal to said governor means indicative of the amount of fuel supplied by the pump to the associated engine.

4. A pump according to claim 3 in which said transducer means includes a transducer and a transducer calibration circuit, the pump including means for controlling said first valve means and said throttle whereby the shuttle can move its predetermined maximum extent in said cylinder for calibration of the transducer.

5. A pump according to claim 4 in which said first valve means and said throttle are operated to move the shuttle its maximum extent only when the demanded fuel is zero and the engine speed above a predetermined value.

* * * * *